US008870731B2

(12) United States Patent
Fuchs et al.

(10) Patent No.: US 8,870,731 B2
(45) Date of Patent: Oct. 28, 2014

(54) DEVICE FOR THE MEMORIZING OF A NUMBER OF PRE-CREASING IN A MATERIAL COAT

(75) Inventors: Siegfried Fuchs, Bendorf (DE); Holger Gingele, Andernach (DE)

(73) Assignee: Winkler + Duennebier GmbH, Neuwied (DE)

( * ) Notice: Subject to any disclaimer, the term of this patent is extended or adjusted under 35 U.S.C. 154(b) by 860 days.

(21) Appl. No.: 12/055,670

(22) Filed: Mar. 26, 2008

(65) Prior Publication Data

US 2008/0242526 A1 Oct. 2, 2008

(30) Foreign Application Priority Data

Mar. 27, 2007 (DE) ..... 10 2007 015 300

(51) Int. Cl.

| | |
|---|---|
| ***B31B 1/25*** | (2006.01) |
| ***B31F 1/10*** | (2006.01) |
| ***B26D 7/26*** | (2006.01) |
| *B26D 3/08* | (2006.01) |
| *B26D 7/01* | (2006.01) |

(52) U.S. Cl.

CPC ..... *B26D 7/2614* (2013.01); *B31B 1/25* (2013.01); *B31B 2201/257* (2013.01); *B26D 3/085* (2013.01); *B26D 7/018* (2013.01); *B31F 1/10* (2013.01); *B31B 2201/255* (2013.01); *B26D 2007/2607* (2013.01)

USPC ..... 493/241; 493/59

(58) Field of Classification Search

CPC B31B 21/00; B31B 2221/10; B31B 2221/20; B31B 2221/402; B31B 29/00; B31B 2219/2672; B31B 37/00; B31B 1/64; B31B 17/00; B31B 1/25

USPC ..... 493/241, 240, 59, 58

See application file for complete search history.

(56) References Cited

U.S. PATENT DOCUMENTS

| | | | | |
|---|---|---|---|---|
| 3,752,042 | A * | 8/1973 | Castille | 493/471 |
| 4,343,215 | A * | 8/1982 | Fuchs | 83/670 |
| 4,823,659 | A * | 4/1989 | Falasconi | 83/100 |
| 5,782,156 | A * | 7/1998 | Collins | 83/331 |
| 6,119,570 | A * | 9/2000 | Okonski et al. | 83/522.15 |
| 6,205,899 | B1 * | 3/2001 | Blumle et al. | 83/98 |
| 6,494,123 | B2 * | 12/2002 | Fuchs | 83/698.51 |

FOREIGN PATENT DOCUMENTS

| | | |
|---|---|---|
| DE | 19640042 | 4/1998 |

* cited by examiner

*Primary Examiner* — Sameh Tawfik
(74) *Attorney, Agent, or Firm* — Leydig, Voit & Mayer, Ltd.

(57) ABSTRACT

A device to stamp a number of creases into a material layer is provided, the device comprising a main roller body non-rotationally arranged on a rotating shaft and a number of holding elements sunk into the main roller body that serve to position and/or affix a first foil having a first creasing ridge on the circumferential surface of the main roller body, which is characterized in that a holding device is provided that can be angularly rotated relative to the longitudinal axis of the rotating shaft and that is configured to position and/or affix at least one additional second foil having a second creasing ridge.

15 Claims, 3 Drawing Sheets

DEVICE FOR THE MEMORIZING OF A NUMBER OF PRE-CREASING IN A MATERIAL COAT

CROSS REFERENCE TO PRIOR APPLICATIONS

Priority is claimed to German Patent Application No. DE 10 2007 0153 00.9, filed Mar. 27, 2007.

The present invention relates to a device for stamping a number of creases into a material layer, especially into a web of material having a prescribed width and layer thickness, or else into a material blank having a prescribed format.

BACKGROUND OF THE INVENTION

Creases stamped into a material layer form folding lines, for example, for the production of envelopes, mailing sleeves or packaging articles of other kinds. The material layer employed can consist of paper, plastic or other elastically and plastically deformable materials. Normally, such a material layer is present in the form of a web having a specifically prescribed width and layer thickness, or else as a blank having a specifically prescribed format. As a rule, stamping a variable number of creases into such a material layer is one of several process steps in a processing chain. For instance, in the production of envelopes, the height of the envelopes is defined by the distance of creases that are adjacent to each other. Other process steps encompass especially cutting and folding processes.

When creases are stamped into a material layer, the latter is usually guided through a lengthwise gap between a creasing roller having two creasing blades and a counter roller fitted with an elastic covering that rolls against this creasing roller. Within the scope of the rolling motion, with every revolution of the creasing roller, the creasing blades generally stamp two creases into the material layer perpendicular to the direction of rotation, and the distance of these creases corresponds to the distance between the creasing blades along the circumference of the creasing roller. Such a device with a creasing roller and a counter roller is disclosed in German patent application DE 196 400 42 A1.

In order to vary the creasing distance, for example, if the format height for envelopes or mailing wrappers changes, the two creasing blades have to be adjusted with respect to each other. For this purpose, one of the creasing blades is arranged stationary on the creasing roller while the other creasing blade is arranged on a segmented tray that can be adjusted in the creasing roller. With this construction, a segment-shaped gap is formed in the creasing roller, and the circumferential extension of the gap is determined by the difference between the minimum and the maximum of the adjustable circumferential distance of the creasing blades. The position of the adjustable segmented tray can be varied within this gap. One disadvantageous aspect of this is that residual gaps of variable sizes remain. These gaps each have to be filled up with additional segmented elements so that the creasing roller on whose outer surface the web of material is being transported has a radius that is essentially constant in all directions orthogonally to the longitudinal axis, and so as to compensate for an unbalance of the creasing roller that would be caused by a change in the position of the segmented tray. Owing to these design-related drawbacks, changing the format is very time-consuming and laborious.

An object of the present invention is to provide a device to stamp a number of creases into a material layer by means of which the format of the creasing distance can be changed with very little effort.

SUMMARY OF THE INVENTION

The present invention provides a device to stamp a number of creases into a material layer, comprising a main roller body non-rotationally arranged on a rotating shaft and a number of holding elements sunk into the main roller body that serve to position and/or affix a first foil having a first creasing ridge on the circumferential surface of the main roller body, which is characterized in that a holding device is provided that can be angularly rotated relative to the longitudinal axis of the rotating shaft and that is configured to position and/or affix at least one additional, second foil having a second creasing ridge.

The present invention provides a connection of the creasing blades to the creasing roller with an indirect mechanical coupling. In the present invention, the creasing blades are configured as creasing ridges that are each formed on a foil, and at least two such foils are arranged on the circumferential surface of the creasing roller in such a way that they can be adjusted with respect to each other. In order to implement such an adjustable arrangement, a creasing roller having a central main roller body is provided on which one of the foils is attached so as to lie flat over the entire surface, as well as a holding device for a second foil that can be angularly adjusted relative to the main roller body. Thus, by adjusting this holding device, the second foil can be adjusted with respect to the main roller body and to the first foil affixed thereto, in order to create a variable circumferential distance between the creasing ridges within an angular range.

The holding device may be arranged relative to the main roller body in such a way that the local distances of the two foils coincide essentially in the area of the creasing ridges relative to the central longitudinal and rotational axis of the rotating shaft to which the main roller body is attached. As a result, a variable number of creases can be stamped into a material layer by rotating the main roller body, whereby the holding device rotates along with the main roller body when the angular rotation relative to the main roller body is set to be constant. With this design, the main roller body does not have a segment-shaped gap and consequently may not have any unbalance during the rotation. In order to change the format, the circumferential distance of the creasing ridges is adjusted exclusively by adjusting the angle of the holding device, thus eliminating the laborious filling up of the remaining segment-shaped gaps.

In a preferred embodiment of the device, the holding device comprises two auxiliary roller bodies which are mounted on both ends of the main roller body on the rotating shaft in such a way that their rotation can be adjusted. The radii of the auxiliary roller bodies relative to the central longitudinal and rotational axis of the rotating shaft advantageously coincide with each other as well as with the radius of the main roller body relative to the central longitudinal and rotational axis of the rotating shaft, so that the inside of the second foil lies at least approximately on the circumferential surface of the main roller body. Such a configuration is characterized by a particularly compact and symmetrical shaping, which is advantageous for low-wear use of the device, even when the roller bodies are operated at quite high rotational speeds.

In a suitable refinement of the device, two other auxiliary roller bodies are provided as holding devices for another foil, said other auxiliary roller bodies being mounted on both ends of the auxiliary roller bodies already present on the rotating shaft in such a way that their rotation can be adjusted.

The addition of two more auxiliary roller bodies as holding devices for yet another foil can be continued iteratively. In this manner, the device can be configured with a plurality of creasing ridges. As an alternative or as a complement to this, it is possible to provide a number of foils with a plurality of creasing ridges at fixed distances from each other. In this context, the creasing ridges can be configured to be axis-parallel straight and/or V-shaped and/or zigzag-shaped and/or wavy, or else adapted to some other prescribed contour.

Advantageously, a clamping system and/or a number of magnets are provided by means of which one or each auxiliary roller body can be affixed relative to the rotating shaft and thus to the main roller body. Such a clamping system and/or such a number of magnets are advantageously arranged in the area of the covering surface of the auxiliary roller body that is opposite from the covering surface of the main roller body.

Furthermore, a scale is preferably provided with which a predefined angular adjustment of the one or each auxiliary roller body relative to the main roller body can be carried out by a number of prescribed angles. In a practical manner, the clamping system also comprises a latching mechanism so that the appertaining roller bodies latch with each other at a prescribed number of angular positions of the main roller body relative to the one or each auxiliary roller body. With this approach, clamping at certain angles can be achieved in a simple manner.

In a favorable refinement of the device, a number of holding elements are sunk into the one or each auxiliary roller body for purposes of affixing the second foil onto the circumferential surface of the appertaining auxiliary roller body or bodies. With such an embodiment, especially the connection of the second foil to the one or each auxiliary roller body can be implemented in the same way as the connection of the first foil to the main roller body. Here, the second foil projects beyond the main roller body, at least in partial areas, with respect to the longitudinal axis of the rotating shaft for purposes of attaching the second foil on the circumferential surface of the appertaining auxiliary roller body or bodies.

Preferably, a magnet element is provided as the holding element. A magnet element entails the advantage that no additional mechanical connection elements are needed to execute the holding function since the holding function is effectuated by the magnetic interaction. Moreover, the holding function can be de-stabilized or overcome by applying an overcritical counterforce, which is particularly advantageous if the mechanical elements are to be configured to be stable with respect to each other but are supposed to be moveable with respect to each other when a specific force is applied. Thus, for instance, a magnet element that is integrated directly into the circumferential surface of the main roller body can execute a holding function for the second foil in the stationary state without the need to first release a mechanical element for an optionally subsequent angular adjustment of the foil with respect to the main roller body and to re-adjust said element after the repositioning.

A peg or pin that is sunk into the main roller body or into an auxiliary roller body is advantageously provided as an additional holding element. In this context, for purposes of attaining maximum holding stability, the longitudinal axis of the peg or pin has an essentially orthogonal or radial orientation relative to the circumferential surface of the roller body in question. Such a pin is employed primarily to create a configuration that, under normal circumstances, is also supposed to be stable against specific applications of force, thus in the case of the device, especially to connect the first foil to the main roller body and to connect the second foil to the one or each auxiliary roller body. In a practical manner, the peg or pin is sunk almost completely into the appertaining roller body, so that it protrudes only slightly or not at all beyond the outer surface of the foil facing away from the roller body.

In another embodiment, a number of pegs or pins can form a peg strip or pin strip, whereby the pegs or pins pass through a groove in order to affix the foil in question to the corresponding roller body, and the length of said groove advantageously matches the length of the roller body. In an alternative or complementary embodiment to this, a clamping strip can be provided to affix the foil to the roller body, said clamping strip being inserted into a groove having an appropriate shape. Such a peg strip or pin strip or clamping strip is preferably provided whenever a plurality of holding elements is needed to create a stable connection between the foil and the roller body, for example, if the roller body is of a sufficient length.

In order to create a full-surface or local-surface contact to the circumferential surface of the main roller body or to the one or each auxiliary roller body, preferably the first and/or second foil has a curved configuration that matches that of said auxiliary roller body. In this manner, the appertaining foil lies on the inside of the circumferential surface of the main roller body. In such a construction, both foils have an essentially identical radius of curvature in the area of their outer surfaces, so that they form an area of a cylindrical circumferential surface. This is advantageous for the transport of a material layer since the material layer can roll off directly on the outer surfaces of the foils, without any impairment caused by a local irregularity of the shape the surface. Moreover, when a machine is used with which the transport of the web of material is effectuated by means of a drawing roller, such contouring allows the tension and thus the drawing of the web of material to be maintained in a particularly favorable manner, as a result of which a particularly constant and reproducible distance can be maintained between the creases.

In an advantageous embodiment, the first foil and the second foil have matching edge shapes so as to mesh with each other. As a result, the second foil can be variably positioned with respect to the first foil in terms of the direction of rotation of the rotating shaft while the foils concurrently mesh with each other alternately. This meshing of the foils ensures that, for every adjustment angle between the minimum and the maximum circumferential distance of the creasing ridges, the outer radius of the roller bodies—with the foils lying thereon—is not consistently reduced relative to the longitudinal axis of the rotating shaft by the thickness of the foils in the area where the foils lie against each other along a line that is parallel to the longitudinal axis. As a result, the material layer being transported on the outer surfaces of the foils is held in the area between the creasing ridges having a relatively constant maximum outer radius. This advantageously translates into a smooth placement of the material layer while undesired deformations are avoided.

In a suitable refinement, the first foil and the second foil have teeth that are configured for intermeshing. Such shaping is easy to produce and stands out for its regularity.

In another preferred embodiment variant of the device, the main roller body and/or one or each auxiliary roller body has a suction-air zone with a number of suction-air openings that open into the appertaining circumferential surface, said openings being configured to be coupled to a system for drawing in air.

Such a suction-air zone serves to create an adhesion of a material blank, said adhesion being uniformly distributed over a portion of the circumferential surface area of the one or each roller body in order to keep the material blank stable within the scope of the stamping of creases and in order to transport the material blank in the machine. In the case of a web of material, in contrast, the holding function is eliminated on the one or each roller body since the holding function is executed externally and/or by the material web itself. The suction-air zone is especially arranged in an area of the one or each roller body that lies in an area that, in the direction of rotation of the rotating shaft, precedes the area where the foils are arranged so as to be in contact with the circumferential side. The two areas can overlap, in which case the foil arranged in one area of the suction-air zone has a number of cutouts for the suction-air openings located underneath the foil.

For example, during the production of an envelope, an end area of the blank forming the bottom flap of the envelope is held in the area of the suction-air zone by a negative pressure in the suction-air openings that is generated by drawing in air. Therefore, when the roller body rotates, the area of the blank that—in terms of the direction of rotation of the rotating shaft—follows is pulled over the outer surfaces of the foils. Within the scope of the rotation of the roller bodies against a counter roller fitted with an elastic covering, the creasing blades stamp two creases into the blank. The creases define the format layout of the future envelope since its height is determined by the distance between the creases.

In a practical version of the device, the main roller body and/or the one or each roller body has a diameter within the range from about 60 mm to about 300 mm. Such a version of the device lends itself especially well for the processing of webs of material, for instance, webs of paper.

In another preferred version of the device, the main roller body and/or the one or each roller body has a diameter within the range from about 100 mm to about 300 mm. Such a version of the device lends itself specially well for the processing of material blanks, for instance, paper blanks in the production of envelopes, mailing sleeves or the like.

BRIEF DESCRIPTION OF THE DRAWINGS

An embodiment of a device according to the invention to stamp a number of creases into a material layer will be described in greater detail below making reference to a drawing. The following is shown.

Parts that correspond to each other in the figures are given the same reference numerals.

DETAILED DESCRIPTION

Figure 1:
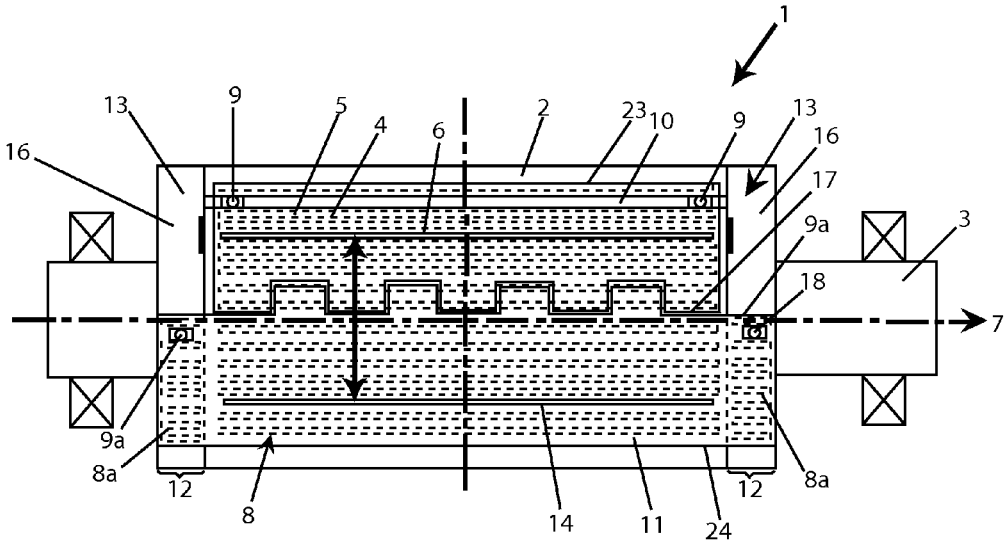
FIG. 1—the device depicted in a longitudinal top view.

FIG. 1 shows the device 1 in a longitudinal top view. A counter roller associated with the device 1 is fitted with an elastic covering The main roller body 2 is non-rotationally positioned on a driven rotating shaft 3. A first foil 5 with a first creasing ridge 6 arranged on it is attached to the circumferential surface 4 of the main roller body 2. The creasing ridge 6 is aligned parallel to the central longitudinal axis 7 of the rotating shaft 3. The first foil 5 is positioned and affixed by means of a number of magnet elements 8 sunk into the circumferential surface 4 and by means of pins 9 that pass through a groove 10 that runs parallel to the central longitudinal axis 7. In a refinement of the embodiment, a plurality of pins 9 can be provided which form a pin strip in the groove 10. As an alternative to the pins 9, it is also possible to use a clamping strip that can be inserted into the groove 10.

Furthermore, a second foil 11 is formed which, in the direction of the longitudinal axis 7, is configured somewhat wider than the first foil 5 and which therefore projects beyond the main roller body 2 on both ends by the same length 12. The second foil 11 is firmly positioned by means of another pin 9*a* on an auxiliary roller body 13 that—relative to the longitudinal axis 7—is mounted on the end of the main roller body 2 on the rotating shaft 3 in such a way that its rotation can be adjusted. On the second foil 11, a second creasing ridge 14 is aligned parallel to the longitudinal axis 7, and the circumferential distance 15 of this second creasing ridge 14 to the first creasing ridge 6 can be seen here in a projection onto the drawing plane. Additional magnet elements 8*a* that, in addition to the pins 9*a*, hold the second foil 11 in place, are sunk into the circumferential surfaces 16 of both auxiliary roller bodies 13. Since the second foil 11 also concentrically surrounds the circumferential surface 4 of the main roller body 2, said second foil 11 is additionally held by the magnet elements 8 which, however, do not prevent an angular rotation of the second foil 11 around the longitudinal axis 7 relative to the main roller body 2 brought about by a likewise angular rotation of the auxiliary roller bodies 13 relative to the rotating shaft 3. Such an angular rotation makes it possible to vary the circumferential distance 15 between the first creasing ridge 6 and the second creasing ridge 14 between the minimum distance position shown here—in which both end edges 17 and 18 of the first and second foils 5 and 11 lie opposite from each other—and a maximum distance position. The shapes of the two end edges 17 and 18 form rectangular teeth configured so that the two foils 5 and 11 mesh with each other. The maximum distance position is characterized in that continuous gaps between the foils 5 and 11 parallel to the longitudinal axis 7 on the circumferential surface of the main roller body are just barely not exposed. As a result, a material layer is continuously transported on the surfaces of both foils 5 and 11, without the material layer being adversely affected by a continuous gap.

Figure 2:
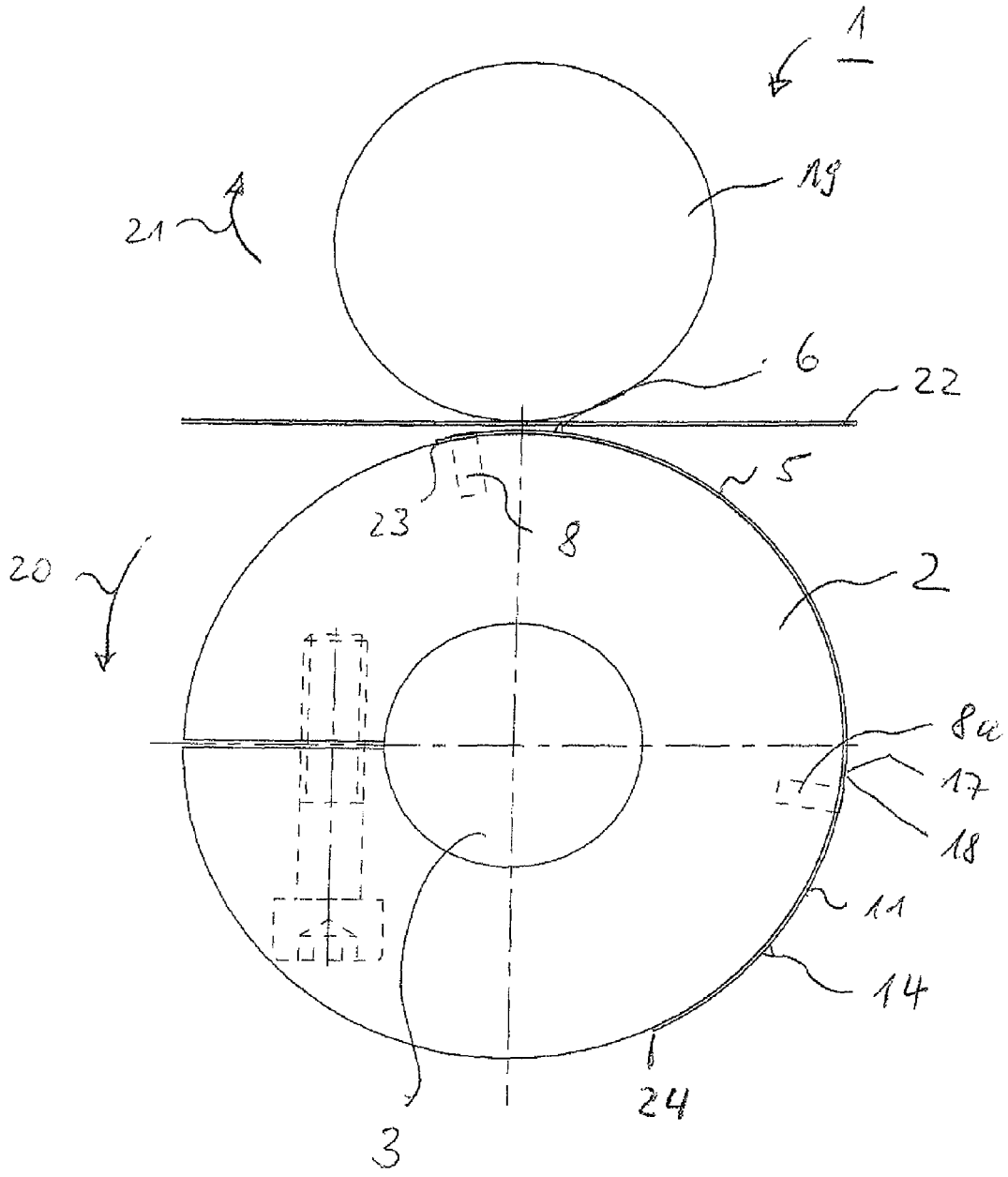
FIG. 2—the device according to FIG. 1 in a cross sectional depiction with a web of material and an elastic counter roller.

FIG. 2 shows the device 1 according to FIG. 1 in a cross sectional depiction in the area of the main roller body 2. This depiction shows a counter roller 19 fitted with an elastic covering that rotates in the direction 21 inverse to the rotational direction 20 of the rotating shaft 3, as a result of which a material layer 22 is transported between the main roller body 2 and the counter roller 19. The first foil 5 and the second foil 11 as well as the creasing ridges 6 and 14 respectively arranged on them are visible here. The depiction shows a snapshot immediately prior to the stamping of a first crease into the material layer 22 by the first creasing ridge 6. Likewise shown is a pin 8 that is arranged vertically offset relative to the depiction plane and that is aligned radially with respect to the main roller body 2 and is sunk almost completely into the latter. The first foil 5 is affixed to the main roller body 2 by means of the pin 8. An additional pin 8*a* analogously affixes the second foil 11 to one of the auxiliary roller bodies which is arranged on the end of the main roller body 2 in the vertical direction relative to the depiction plane and which cannot be seen here. Likewise visible are the two opposing end edges 17 and 18 of the first and second foils 5, 11, respectively, as well as the leading end edge 23 of the first foil 5 in the rotational direction 20, and also the trailing end edge 24 of second foil 11 in the rotational direction 20.

Figure 3:
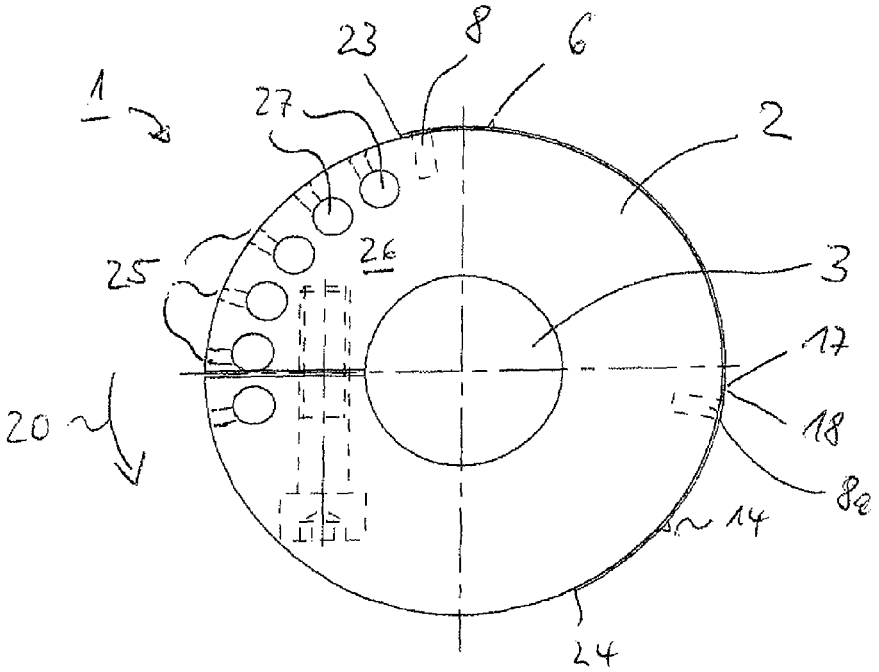
FIG. 3—a cross section of the main roller of another device according to the invention, with suction-air openings.

FIG. 3 shows a cross section of the main roller 2 of another device 1 according to the invention, with suction-air openings 25 that are sunk into a suction-air zone 26 in the area—relative to the rotational direction 20—preceding the first foil 5 on the circumferential surface of the main roller body 2. When air is drawn in from the side channels 27 that are connected to the suction-air openings 25, a negative pressure is generated in the area of the suction-air zone 26, by means of which a material blank is held in place on the main roller body 2 while the latter is rotating. Additional details of the depiction correspond to those in FIG. 2 and can be seen there.

Figure 4:
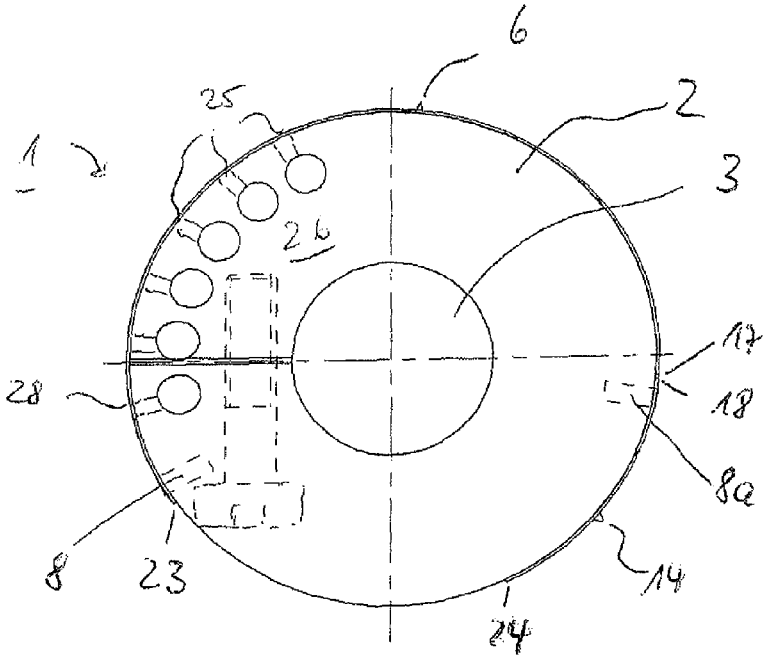
FIG. 4—a cross section of another main roller with suction-air openings.

FIG. 4 shows a cross section of the main roller 2 of another device 1 according to the invention, with suction-air openings 25 analogous to those in FIG. 3, whereby here, the suction-air zone 26 is completely surrounded by the first foil 5. The first foil 5 has cutouts 28 configured as elongated holes for the suction-air openings 25. Additional details of the depiction correspond to those in FIG. 3 and can be seen there.

LIST OF REFERENCE NUMERALS

1 device
2 main roller body
3 rotating shaft
4 circumferential surface of the main roller body
5 first foil
6 first creasing ridge
7 central longitudinal axis of the rotating shaft
8 magnet element
8*a* additional magnet element
9 pin
9*a* additional pin
10 groove
11 second foil
12 length
13 auxiliary roller body
14 second creasing ridge
15 circumferential distance
16 circumferential surface of an auxiliary roller body
17 end edge of the first foil
18 end edge of the second foil
19 counter roller
20 rotational direction of the rotating shaft
21 inverse rotational direction
22 material layer
23 leading end edge of the first foil
24 trailing end edge of the second foil
25 suction-air opening
26 suction-air zone
27 side channel
28 cutout

The invention claimed is:

1. A device for stamping a plurality of creases into a material layer comprising:

a rotating shaft having a longitudinal axis and a rotation direction;

a main roller body arranged on the rotating shalt and having a circumferential surface;

a first foil having a first creasing ridge;

a second foil having a, second creasing ridge;

a first plurality of holding elements sunk into the main roller body, the first plurality of holding elements affixing the first foil on the circumferential surface of the main body;

an auxiliary roller body that is angularly rotatable about the longitudinal axis of the rotating shaft such that the auxiliary roller body is rotatable relative to the main roller body, the auxiliary roller body having a circumferential surface and being mounted on an end of the main roller body; and a second plurality of holding elements sunk into the auxiliary roller body, the second plurality of holding elements affixing the second foil on the circumferential surface of the auxiliary roller body.

2. The device as recited in claim 1, further comprising a clamping system for affixing the auxiliary roller body to the rotating shaft, the clamping system disposed on at least one of the main roller body and the auxiliary roller body.

3. The device as recited in claim 2, wherein the clamping system includes a plurality of magnets.

4. The device as recited in claim 1, wherein the first plurality of holding elements includes a magnet.

5. The device as recited in claim 1, wherein the second plurality of holding elements includes a magnet.

6. The device as recited in claim 1, wherein the first plurality of holding elements includes a pin having a pin longitudinal axis oriented essentially radial relative to the circumferential surface of the main roller body.

7. The device as recited in claim 1, wherein the second plurality of holding elements includes a pin having a pin longitudinal axis oriented essentially radial relative to the circumferential surface of the auxiliary roller body.

8. The device as recited in claim 1, wherein the first foil has a curved configuration body that matches the circumferential surface of the main roller body.

9. The device as recited in claim 1, wherein the second foil has a curved configuration body that matches the circumferential surface of the first auxiliary roller body.

10. The device as recited in claim 1, wherein the first foil and the second foil each have a corresponding end edge configured so that the second foil is variably positionable with respect to the first foil relative to a rotation direction of the rotating shaft and wherein the second foil is meshable with the first foil alternately.

11. The device as recited in claim 10, wherein the first foil end edge and the second foil end edge each include teeth configured for meshing.

12. The device as recited in claim 1, further comprising a plurality of suction-air openings disposed on the main roller body and wherein the openings are configured to couple to a system for drawing in air.

13. The device as recited in claim 1, further comprising a plurality of suction air openings disposed on the first auxiliary roller body and wherein the openings are configured to couple to a system for drawing in air.

14. The device as recited in claim 1, wherein the main roller body has a diameter within a range of 60 mm to 300 mm.

15. The device as recited in claim 1, wherein the auxiliary roller body has a diameter within a range of 60 mm to 300 mm.

* * * * *